US006343714B1

(12) United States Patent
Tichenor

(10) Patent No.: US 6,343,714 B1
(45) Date of Patent: Feb. 5, 2002

(54) ANTI-GRAFFITI AEROSOL SPRAY CAN HAVING AN INTERNAL SPRAY HEAD VALVE CONTROL ASSEMBLY

(75) Inventor: Clyde L. Tichenor, Somis, CA (US)

(73) Assignee: Electro Spray Inc., Los Angeles, CA (US)

( * ) Notice: Subject to any disclaimer, the term of this patent is extended or adjusted under 35 U.S.C. 154(b) by 0 days.

(21) Appl. No.: 09/591,318

(22) Filed: Jun. 9, 2000

Related U.S. Application Data

(60) Provisional application No. 60/138,556, filed on Jun. 11, 1999.

(51) Int. Cl.[7] ..... B67D 5/33

(52) U.S. Cl. ..... 222/153.11; 222/504; 222/402.11; 222/464.5; 222/61

(58) Field of Search ..... 222/153.11, 153.13, 222/153.14, 402.1, 402.11, 402.15, 464.3, 464.5, 464.1, 504, 52, 61; 251/89, 129.01, 129.2, 65; 239/337, 580, 583; 137/590, 383

(56) References Cited

U.S. PATENT DOCUMENTS 3,666,144 A * 5/1972 Winder ..... 222/70
4,618,099 A * 10/1986 Nagao et al. ..... 239/332
4,971,257 A * 11/1990 Birge ..... 239/708
4,972,975 A * 11/1990 Fuhrig ..... 222/182
5,014,884 A * 5/1991 Wunsch ..... 222/333
5,069,391 A * 12/1991 Seasholtz ..... 239/332
5,385,271 A * 1/1995 Bierend et al. ..... 222/153
5,427,277 A * 6/1995 Bierend et al. ..... 222/153.09
5,603,433 A * 2/1997 Rene ..... 222/153.11
5,675,318 A * 10/1997 Hunt, Jr. ..... 340/540
5,791,520 A * 8/1998 Tichenor ..... 222/82
5,850,943 A * 12/1998 Tichenor et al. ..... 222/153.11
5,855,297 A * 1/1999 Tichenor et al. ..... 222/61

* cited by examiner

*Primary Examiner*—Kevin Shaver
*Assistant Examiner*—Patrick Buechner
(74) *Attorney, Agent, or Firm*—Albert O. Cota

(57) ABSTRACT

An anti-graffiti aerosol spray can (10) that features an internal spray head valve control assembly (60). The assembly (60) includes a spray head valve actuator (62) that can consist of a solenoid (63), a valve (65), a bi-metallic detent structure (122) or any other electrically-operated device having an open and shut mechanism. The internal spray head valve control assembly (60) operates by the application of an electrical power source (98) that is applied from two electrically isolated sections of the spray can (12). The assembly (60) can be designed to be operated by an electrical device that is attached directly to the aerosol spray can (12), or the assembly (60) can be operated by an RF receiver (150) that is energized by a remotely-located RF transmitter (152) that is energized by a d-c power supply (154) connected to a 120-vac, 60 Hz utility power source (156).

16 Claims, 4 Drawing Sheets

ANTI-GRAFFITI AEROSOL SPRAY CAN HAVING AN INTERNAL SPRAY HEAD VALVE CONTROL ASSEMBLY

This patent application claims the benefit of Provisional Patent Application No. 60/138,556 filed Jun. 11, 1999.

TECHNICAL FIELD

The invention pertains to the general field of aerosol spray cans and more particularly to an aerosol spray can which incorporates an internal spray head valve control assembly that is energized when an electrical current is applied to two electrically isolated sections of the aerosol spray can. When the activating assembly is energized the spray can becomes operational.

BACKGROUND ART

Currently, government agencies are turning towards legislation requiring the sale and use of spray paint cans that incorporate technologies to prevent graffiti. Obviously such legislation offers a preventative solution not previously utilized which is necessary because graffiti is an uncontrollable epidemic. Even the spray paint industry estimates that graffiti clean-up and removal costs taxpayers an estimated $7 billion a year nationwide. Further breakdown of such figures will show that the use of spray paint costs the taxpayer $10 for each can of spray paint used. Vandals armed with aerosol spray paint account for the vast majority of graffiti in most communities. At least $4 billion of the damage nationwide is attributed to aerosol spray paint.

Graffiti decreases property value, cripples business and demoralizes neighborhoods. Graffiti also brings other criminal and gang-related activities into these affected areas and often precipitates the commission violent crime. It also imposes a burden upon law enforcement and our criminal justice system, by reducing resources available to address other crime problems.

The pressurized spray cans disclosed require only minor modifications to the manufacturing process and the portability of the spray paint can be eliminated. This non-portability makes such spray cans useless for graffiti in public areas, while still permitting their use in or near the home, garage or business. The required minor modifications in the manufacturing process would be passed on to consumers in the form of a small price increase.

The spray can modifications also benefit the paint industry since such modified cans can be sold in normal, open-counter locations. Alternatively, most sales now require going to a locked cabinet for customer access, and some legislatures are passing or have pending bills that totally ban the sale of spray paint in such cans. These last two solutions are drastic and hurt both retail sales and the wholesaler, as well as the manufacturer.

A search of the prior art did not disclose any patents or other literature that read directly on the claims of the instant invention. Particularly, no patents were found that disclosed an aerosol paint spray can which incorporates an internal valve or the like that is energized when an electrical current is applied to two electrically isolated sections of the can. When the valve is energized the can becomes operational. However, the following U.S. patents were considered related:

| U.S. Pat. No. | INVENTOR | ISSUED | |
|---|---|---|---|
| 5,855,297 | Tichenor | 5 January | 1999 |
| 5,014,844 | Wunsch | 14 May | 1991 |
| 4,972,975 | Fuhrig | 27 November | 1990 |
| 4,971,257 | Birge | 20 November | 1990 |

The U.S. Pat. No. 5,855,297 patent discloses a wireless-operated anti-graffiti spray can system which allows a pressurized spray can to be electronically operated from a remote location. The system is disclosed in two designs: in the first design, a spray can activating device consists of a solenoid/valve assembly which operates in combination with an electro-magnetic coil to control the spray can. In the second design, the activating device consists of an electro-mechanical solenoid which operates an articulated spray control leaf that controls the spray can. In both designs, a transmitting unit is utilized that can only be enabled when connected to a utility a-c power source. The transmitting unit produces an RF signal that is received by a receiving unit located remotely and adjacent to the spray can activating device. The receiving unit produces a power signal which, in the first design, causes the activating device to produce a magnetic field which causes the solenoid/valve assembly to energize; in the second design the power signal is applied directly to the solenoid which causes the solenoid to energize. In both designs, the spray can only be used after either the solenoid/valve assembly, or the solenoid has been energized.

The U.S. Pat. No. 5,014,884 Wonsch patent discloses an aerosol spray can that includes a spray mechanism for finely atomizing fluids through a hydraulically-operated pump. The spray mechanism is inserted into a housing which is connected with the supply container for the liquid through a close-fitted or frictional locking connection. The spray mechanism incorporates a battery operated gear pump in which, the suction line of the pump is connected through an opening in the bottom of the housing into the supply container. The supply container is equipped with a venting line, whereby the gear pump includes a pressure tube at its output which is connected with a discharge nozzle.

The U.S. Pat. No. 4,972,975 Fuhrig patent discloses a housing that stores a battery that powers an electric motor that operates a compressor for producing compressed air in combination with a suction unit and a pressure joint. A product container that includes a spray nozzle is placed inside the housing with a connection between the pressure joint of the compressor and the interior of the product container. The compressor pressurizes the product container through an aperture thereby forcing the liquid through the container spray nozzle.

The U.S. Pat. No. 4,971,257 Birge patent discloses an electrostatic particle spraying apparatus. The apparatus includes a hand held triggering mechanism that includes a d-c power source and a coupling sleeve into which a conventional aerosol spray can is inserted when the triggering mechanism is squeezed, a hammer depresses the nozzle tip of the aerosol can, releasing the pressurized fluid of the can from the nozzle tip.

This application is also related to the applicant's copending application Ser. No. 08/095,851, filed Jul. 23, 1993 now U.S. Pat. No. 5,385,271 and entitled Utility-Power Operated Aerosol Spray Can.

For background purposes and indicative of the art to which the invention relates, reference may be made to the following remaining patents found in the pre-examination search:

| PATENT NO. | INVENTOR | ISSUED |
|---|---|---|
| 5,069,391 | Seasholtz | 3 December 1991 |
| 4,618,099 | Nagad et al | 21 October 1986 |

DISCLOSURE OF THE INVENTION

The anti-graffiti aerosol spray can disclosed herein is designed to prevent or at least minimize "graffiti taggers" from using an aerosol spray can to tag buildings and other public property. In its basic design the inventive anti-graffiti aerosol spray can consists of:

a) An aerosol spray can comprising:

(1) An upper enclosure having an upper opening and an insulated lower opening, wherein to the upper opening is attached a spray head valve support structure having an outer conductive section and an inner insulting section. The spray head valve support section supports a spray head that is externally accessed by a spray head.

(2) A lower enclosure having a sealed lower surface and an upper opening that is attached to the insulated lower opening on the upper enclosure.

b) A spray head valve control assembly located within the aerosol spray can. The assembly has means for being electrically actuated when an electrical current is applied between the upper or lower enclosure and the outer conductive section of the spray head valve support structure. When the spray head valve control assembly is actuated, the spray head valve opens allowing the spray head to be operated which then allows the fluid in the aerosol spray can to be sprayed.

The spray head valve control assembly is comprised of a spray head valve actuator that can consist of a solenoid, a valve, a bi-metallic structure, a muscle wire or any type of device that can be moved from a first position to a second position when a current is applied to the device. The electrical power source applied to the spray activating assembly consists of a low-voltage high-frequency current. Typically 6-volts to 12-volts at a frequency between 800 Hz to 1200 Hz.

The electrical power source can be detachably attached directly to the aerosol spray can or the electrical power source can consist of an RF receiver and an RF transmitter. In the later case the RF receiver is detachably attached to the spray can and the RF transmitter is remotely located from the spray can. The RF transmitter is powered by a d-c power supply that is connected to a utility 120-vac, 60 Hz power source. When the transmitter is enabled an RF signal is transmitted and received by the RF receiver at which time the spray head valve actuator is energized allowing the fluid in the spray can to be sprayed when the spray head valve is operated.

In view of the above disclosure it is the primary object of the invention to enclose an electrically controlled spray head valve control assembly within an aerosol spray can. And, to allow the assembly to be activated by an electrical current that is applied between two electrically isolated sections of the aerosol spray can.

In addition to the primary object of the invention it is also an object of the invention to produce an anti-graffiti aerosol spray can that:

takes advantage of the fact that the upper enclosure of an aerosol spray can has two sections that are electrically insulated from each other, is reliable and relatively maintenance free, and is cost effective from both a consumer's and manufacturer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
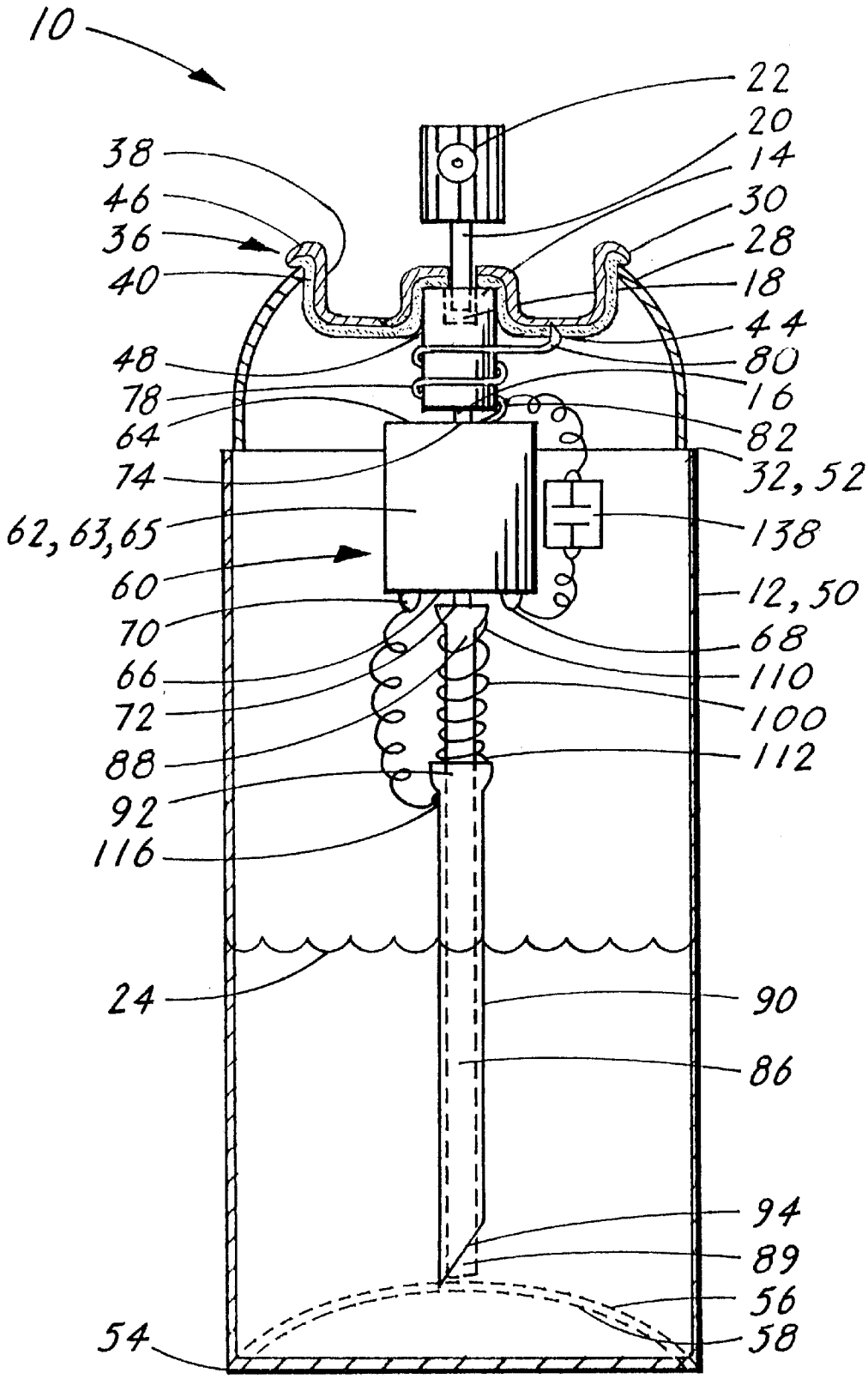
FIG. 1 is a partial cross-sectional view of a first embodiment of an anti-graffiti aerosol spray can having an internal spray head valve control assembly.

The best mode for carrying out the invention is disclosed in two embodiments for an anti-graffiti aerosol spray can 10, hereinafter "spray can 10". Each embodiment utilizes a spray head valve control assembly that is further disclosed in four designs. The spray can 10, as shown in FIGS. 1–4, is comprised of the following major elements: an aerosol spray can 12 having a spray head valve 14, an upper enclosure 28, a spray head valve support structure 36 and a lower enclosure 50; and a spray head valve control assembly 60, which utilizes various elements depending on which embodiment is employed.

Figure 2:
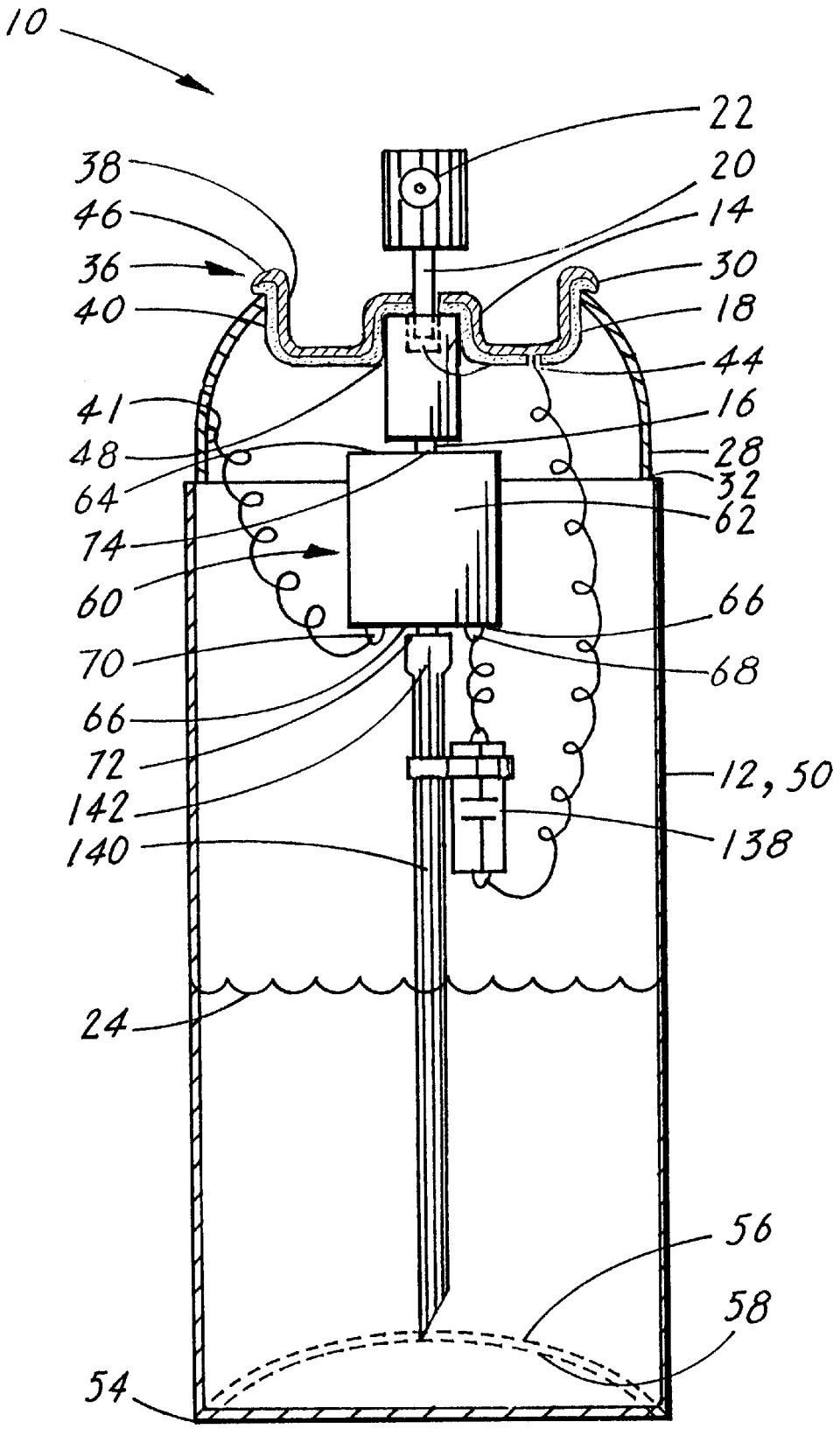
FIG. 2 is a partial cross-sectional view of a second embodiment of an anti-graffiti aerosol spray can having an internal spray head valve control assembly.

Both the first embodiment, as shown in FIG. 1, and the second embodiment, as shown in FIG. 2, utilize the aerosol spray can 12. The aerosol spray can 12 is comprised of the spray head valve 14, which has a lower fluid port 16 and an upper cavity 18 into which is inserted a plunger 20. When the plunger 20 is depressed, the spray head valve 14 opens, thus allowing a fluid 24 in the aerosol spray can 12 to be sprayed from the spray head 22.

Located at the top of the spray can 12 is the upper enclosure 28, which is comprised of an upper opening 30 and an insulated lower opening 32. The spray head valve support structure 36, as shown in FIGS. 1 and 2 is comprised of an outer conductive section and a bonded inner insulating section 40. On one side of the inner insulating section 40 is an opening 44 which exposes an area of the outer conductive section 38.

The spray head valve support structure 36 is further comprised of outer ends 46 that are crimped, as shown in FIG. 1, to the upper opening 30 of the upper enclosure 28, and an upward-extending cavity 48 that is dimensioned to enclose the spray head valve 14.

The lower enclosure 50 has an upper opening se that is attached to the insulated lower opening 32 of the upper enclosure 28, and a sealed lower surface 24 that includes an upper surface 56 and a lower surface 58.

The first embodiment of the spray can 10, as shown in FIG. 1, utilizes a spray head valve control assembly 60 that is located within the aerosol spray can 12 and that is comprised of the following major elements: an electrical spray head valve actuator 62, a first compression spring 78, a siphon tube 86, a siphon tube housing 90, and a second compression spring 100.

The electrical spray head valve actuator 62 has a non-conductive upper surface 64, a lower surface 66, a first electrical input 68, a second electrical input 70, a fluid input port 72 and a fluid output port 74. The fluid output port 74 is connected to the lower fluid port 16 on the spray head valve 14.

The first compression spring 78 has a sharpened first end 80 and a second end 82. The sharpened first end 80 is inserted through the opening 44 on the spray head valve support structure 36 to allow the sharpened first end 80 to make electrical contact with the outer conductive section 38 of the spray head valve support structure 36. The second end 82 rests upon the non-conductive upper surface 64 of the spray head valve actuator 62 and has means for making an electrical contact with the first electrical input 68 on the actuator 62, The siphon tube 86 has an upper end 88 and a lower end 89. The upper end 88 is attached to the input port 72 of the actuator 62, and the lower end 89 terminates a distance above the upper surface 56 of the sealed lower end 54 of the lower enclosure 50.

The siphon tube housing 90 is constructed of an electrically conductive material, and is dimensioned to slidably fit over the siphon tube 86. The siphon tube housing 90 has a flared upper end 92 and a sharpened lower end 94 that makes electrical contact with the upper surface 56 of the sealed lower end 54 of the lower enclosure 50.

The second compression spring 100 has a first end 110 and a second end 112. The first end 110 interfaces with the lower surface 66 of the actuator 62, and the second end 112 interfaces with the flared upper end 92 of the siphon tube housing 90. The second compression spring 100 maintains the siphon tube housing 90 biased in a downward direction, which forces electrical contact to be made between the lower end 94 of the siphon tube housing 90 and the upper surface 56 of the sealed lower end 54 of the enclosure 50.

As shown in FIG. 1, an electrical connection 116 is made between the siphon tube housing 90 and the second electrical input 70 of the actuator 62. When an external electrical power source 98 (not shown) is applied between the upper or lower enclosure 28,50 and the outer conductive section 38 of the spray head valve support structure 36, an electrical current flows sequentially from the upper or lower enclosure 28,50 the sealed lower surface 54, the siphon tube housing 90, the second electrical input 70, the first electrical input 68, the first compression spring 78 and the outer conductive section 38 of the spray head valve support structure 36. The electrical current energizes the actuator 62, thus causing the spray head valve 14 to open and allow the fluid 24 in the aerosol spray can 12 to be sprayed from the spray can when the plunger 20 is depressed by the spray head 22.

The external electrical power source 98 supplies 6-volts to 12-volts, with 6-volts preferred, at a frequency of 1000 Hz, and is comprised of a low-voltage, high-frequency power source.

Figure 3A:
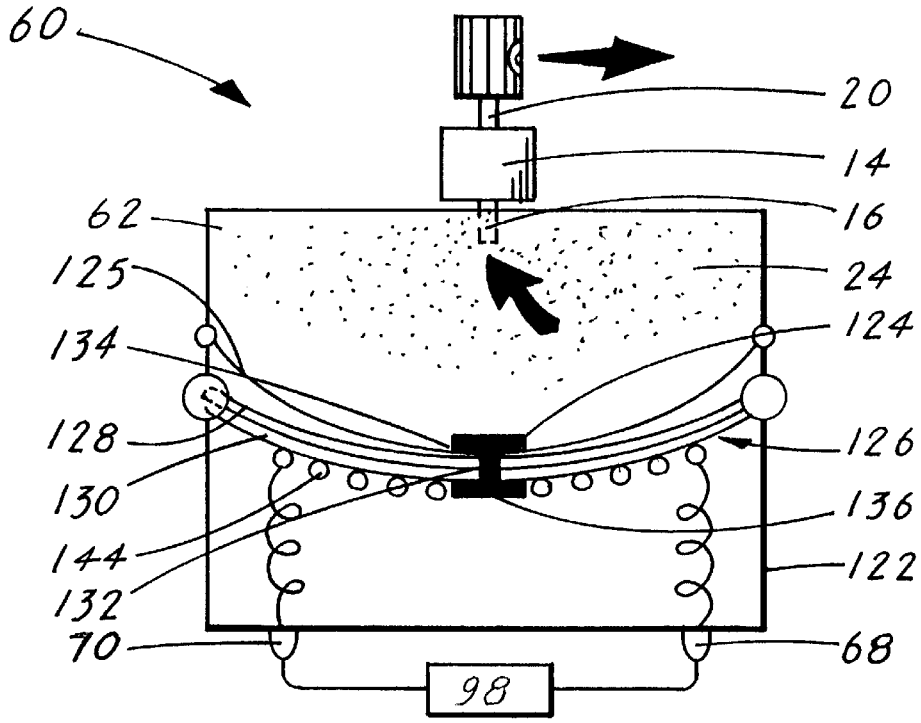
FIG. 3A is a partial cross-sectional view of a spray head valve actuator consisting of a bi-metallic detent structure shown in the activated position.
Figure 3B:
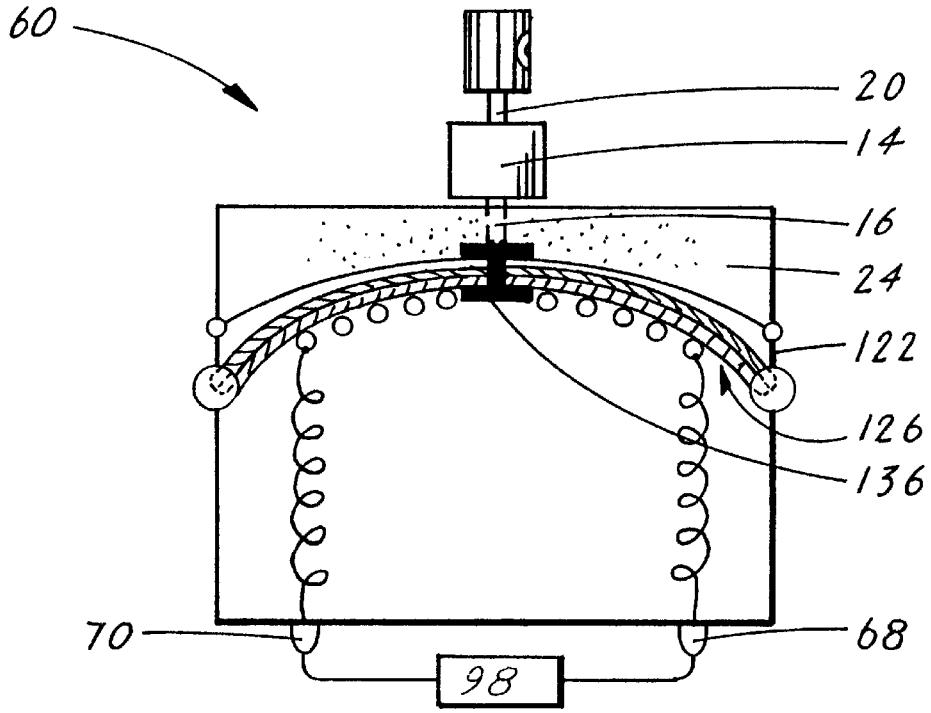
FIG. 3B is a partial cross-sectional view of the bi-metallic detent structure shown in the de-activated position.

The spray head valve actuator 62 can be comprised of a solenoid 63, a valve 65, or a bi-metallic detent structure 122. The bi-metallic detent structure 122, as shown in FIGS. 3A and 3B, is itself comprised of a compliant pad 124, a diaphragm 125, a bi-metallic assembly 126, and a separator 132. The bi-metallic assembly 126 has an upper element 128 and a lower element 130, with the lower element 130 attached to an electrical heating source 144. The separator 132 has an upper surface 134 to which is attached the compliant pad 124 and the diaphragm 125, and a lower section 136 having means for being centrally retained by the bi-metallic assembly 126. When the electrical power source 98, which is attached to the first and second electrical inputs 68,70, is "on", the bi-metallic assembly 126 assumes a dished-down position, as shown in FIG. 3A, which allows the fluid 24 in the aerosol spray can 12 to be sprayed. Conversely, when the power source 98 is "off", the bi-metallic assembly 126 cools and assumes a dished-up position, as shown in FIG. 3B, which causes the complaint pad 124 to interface with and seal the lower fluid port 16 of the spray valve 14, thus preventing any fluid 24 from being sprayed.

Figure 4:
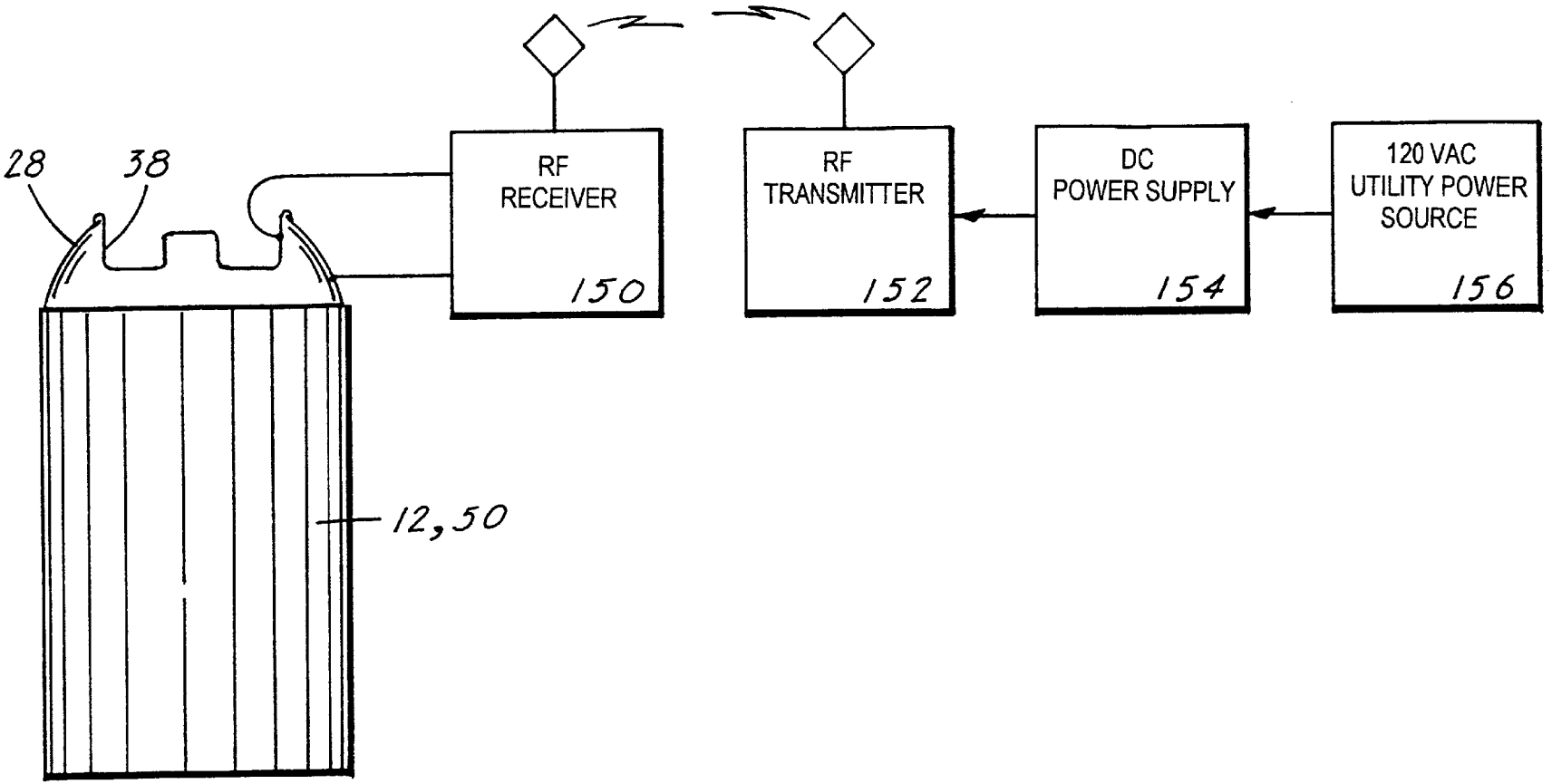
FIG. 4 is a block diagram illustrating a spray head valve that is activated by an RF receiver that is energized by a remotely located RF transmitter.

The spray head valve actuator 62 may further be comprised of an RF receiver 150 and transmitter 152 as shown in FIG. 4. The RF receiver 150 has an output connected across the upper or lower enclosure 28,50 and the outer conductive section 38 of the aerosol spray can 12. The RF transmitter is remotely located and is powered by a d-c power supply 154 connected to a 120 vac, 60 HZ utility power source 156. When the RF transmitter 152 is energized an RF signal is transmitted that is received by the RF receiver 150. When the RF receiver is energized, an RF signal is produced by the receiver which enables the spray head valve actuator 62 which allows the fluid 24 in the aerosol spray can 12 to be sprayed. The details of the RF activation system are disclosed in the applicant's U.S. Pat. No. 5,855,297 which is incorporated herein by reference.

As shown in FIG. 1, the spray activating assembly 60 further comprises at least one capacitor 138 connected in series between the first 68 and second 70 electrical inputs on the spray head valve actuator 62. The capacitor 138 prevents electrical power source other than the external electrical Power source 98 from energizing the actuator 62.

The second embodiment of the spray can 10, as shown in FIG. 2, utilizes a spray head valve control assembly 60 located within the aerosol spray can 12 and having an electrical spray valve actuator 62 and an electrical connection.

The actuator 62 has a non-conducting upper surface 64, a lower surface 66, a first electrical input 68, a second electrical input 70, a fluid input port 72 and a fluid output port 74. The fluid output port 74 is connected to the lower fluid port 16 on the spray head valve 14, and the fluid input port 72 is connected to an upper end 142 of a siphon tube 140. As in the first embodiment, the spray head valve actuator 62 of the second embodiment, may also be comprised of a solenoid 63, a valve or a muscle wire. The muscle wire, which is also referred to as a memory wire, is typically made of a titanium nickel alloy, and has two possible shapes: when the muscle wire is cooled the wire exhibits a stretched shape; when the wire is applied to a heat source the wire exhibits a contoured shape. Thus, a wire having a proper length and cross-section can be used as the valve actuator 62. Typically, the muscle wire would be implemented in a design similar to the design shown in FIGS. 3A and 3B.

The electrical connection is between the second electrical input 70 on the spray valve actuator 62 and the upper or lower enclosure 28,50 and between the first electrical input 68 on the actuator 62 and the opening 44 on the spray head valve support section 36. When an external electrical power source 98 (not shown) is applied between the upper or lower enclosure 28,50 and the outer conductive section 38 of the spray head valve support structure 36, an electrical current flows sequentially from the upper or lower enclosure 28,50, the second electrical input 70, the first electrical input 68, a capacitor 138 and through the opening 44 on the spray head valve support structure 36. The electrical current energizes the actuator 62, thus causing the spray head valve 14 to open and allow the fluid 24 in the aerosol spray can 12 to be sprayed when the spray head ee is operated.

The external electrical power source 98 is comprised of a low-voltage, high-frequency power source. This source typically supplies 6-volts to 12-volts, with 6-volts preferred, at a frequency of 1000 HZ.

While the invention has been described in complete detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

What is claimed is:

1. An anti-graffiti aerosol spray can comprising:

a) an aerosol spray can comprising:

(1) an upper enclosure having an upper opening and an insulated lower opening, wherein to the upper opening is attached a spray head valve support structure having an outer conductive section and an inner insulating section, wherein said spray head valve support structure supports a spray head valve that is externally accessed by a spray head, (2) a lower enclosure having a sealed lower surface and an upper opening that is attached to the insulated lower opening, and b) a spray head valve control assembly located within said aerosol spray can, said assembly having means for being electrically actuated when an electrical current is applied between the outer conductive section on said spray head valve support structure and the upper or lower enclosure, wherein when said spray head valve control assembly is actuated, said spray head valve opens allowing the spray head to be operated which then allows the fluid in the aerosol spray can to be sprayed.

2. An anti-graffiti aerosol spray can comprising:

a) an aerosol spray can comprising:

(1) a spray head valve having a lower fluid port and an upper cavity into which is inserted a spray head, wherein when the spray head is depressed, the spray head valve opens allowing a fluid in said aerosol spray can to be sprayed from the spray head, (2) an upper enclosure having an upper opening and an insulated lower opening, (3) a spray head valve support structure having:

(a) an outer conductive section and a bonded inner insulating section, wherein on one side of the inner insulating section is an opening which exposes an area of the outer conductive section, (b) outer ends that are crimped to the upper opening of said upper enclosure, (c) an upward-extending cavity dimensioned to enclose said spray head valve, (4) a lower enclosure having an upper opening that is attached to the insulated lower opening of said upper enclosure and a sealed lower surface having an upper surface and a lower surface, b) a spray head valve control assembly located within said aerosol spray can said assembly comprising:

(1) an electrical spray head valve actuator having a non-conductive upper surface, a lower surface, a first electrical input, a second electrical input, a fluid input port and a fluid output port, wherein the fluid output port is connected to the lower fluid port on said spray head valve and the fluid input port is connected to an upper end of a siphon tube, (2) a first compression spring having a sharpened first end and a second end, wherein the sharpened first end is inserted through the opening on said spray head valve support structure to make electrical contact with the outer conductive section of said spray head valve support structure, wherein the second end rests upon the non-conductive upper surface of said actuator and has means for making an electrical contact with the first electrical input on said actuator, (3) a siphon tube having an upper end and a lower end, wherein the upper end is attached to the input port of said actuator and the lower end terminates a distance above the upper surface of the sealed lower end of said lower enclosure, (4) a siphon tube housing constructed of an electrically conductive material and dimensioned to slidably fit over said siphon tube, said siphon tube housing having a flared upper end and a sharpened lower end that makes electrical contact with the upper surface of the sealed lower end of said lower enclosure, (5) a second compression spring having a first end and a second end, wherein the first end interfaces with the lower surface of said actuator and the second end interfaces with the flared upper end of said siphon tube housing, wherein said second compression spring maintains the siphon tube housing biased in a downward direction which forces electrical contact to be made between the lower end of said siphon tube housing and the upper surface of the sealed lower end of said enclosure, and (6) an electrical connection between the siphon tube housing and the second electrical input of said actuator, wherein when an external electrical power source is applied between the upper or lower enclosure and the outer conductive section of said spray head valve support structure an electrical current flows sequentially from the upper or lower enclosure, the sealed lower surface, said siphon tube housing, the second electrical input, the first electrical input, the first compression spring and the outer conductive section of the spray head valve support structure, said actuator is energized causing said spray head valve to open and allow the fluid in the aerosol spray can to be sprayed when the spray head is operated.

3. The anti-graffiti aerosol spray can as recited in claim 2 wherein said spray head valve actuator is comprised of a solenoid.

4. The anti-graffiti aerosol spray can as recited in claim 2 wherein said spray head valve actuator is comprised of a valve.

5. The anti-graffiti aerosol spray can as recited in claim 2 wherein said spray head valve actuator is comprised of a bi-metallic detent structure comprising:

a) a compliant pad, b) a diaphragm, c) a bi-metallic assembly comprising an upper element and a lower element wherein the lower element is attached to an electrical heating source, and d) a separator having an upper surface to which is attached the compliant pad and the diaphragm, and a lower section having means for being centrally retained by the bi-metallic assembly, wherein when said electrical power source, which is attached to the first and second electrical inputs, is "on", the bi-metallic assembly assumes a dished-down position which allows the fluid in said aerosol sprang can to be sprayed, conversely, when the power source is "off", the bi-metallic assembly cools and assumes a dished-up position, wherein the complaint pad interfaces with and seals the lower fluid port of the spray head valve to prevent any fluid from being sprayed.

6. The anti-graffiti aerosol spray can as recited in claim 2 wherein said spray head valve actuator comprises:

a) an RF receiver having an output connected across the upper or lower enclosure and the outer conductive section of said spray head valve support structure, and b) a remotely located RF transmitter that is powered by a d-c power supply connected to a 120-vac, 60 Hz utility power, wherein when said RF transmitter is energized an RF signal is transmitted that is received by said RF receiver, wherein when said RF receiver is energized an RF signal produced by the receiver enables said spray head valve actuator is actuated which allows the fluid in said aerosol spray can to be sprayed.

7. The anti-graffiti aerosol spray can as recited in claim 2 wherein said external electrical power source provides a low-voltage high-frequency power source.

8. The anti-graffiti aerosol spray can as recited in claim 2 wherein said electrical power source supplies 6-volts at a frequency of 1000 Hz.

9. The anti-graffiti aerosol spray can as recited in claim 2 wherein said spray head valve control assembly further comprises at least one capacitor connected in series between the first and second electrical inputs on said spray head valve actuator, wherein said at least one capacitor prevents an electrical power source other than said external electrical power source from energizing said actuator.

10. An anti-graffiti aerosol spray can comprising:

a) an aerosol spray can comprising:

(1) a spray head valve having a lower fluid port and an upper cavity into which is inserted a spray head, wherein when the spray head is depressed, the spray head valve opens allowing a fluid in said aerosol spray can to be sprayed from the spray head, (2) an upper enclosure having an upper opening and an insulated lower opening, (3) a spray head valve support structure having:

(a) an outer conductive section and a bonded inner insulating section, wherein on one side of the inner insulating section is an opening which exposes an area of the outer conductive section, (b) outer ends that are crimped to the upper opening of said upper enclosure, (c) an upward extending cavity dimensioned to enclose said spray head valve, (4) a lower enclosure having an upper end that is attached to the lower edge of said upper enclosure and a sealed lower end having an upper surface and a lower surface, b) a spray head valve control assembly located within said aerosol spray can, said assembly comprising:

(1) a spray head valve actuator having a non-conducting upper surface, a lower surface, a first electrical input, a second electrical input, a fluid input port and a fluid output port, wherein the fluid output port is connected to the lower fluid port on said spray head valve and the fluid input port is connected to an upper end of a siphon tube, (2) an electrical connection between the second electrical input on said spray valve actuator and the upper enclosure and between the first electrical input on said actuator and the opening on said spray head valve support structure, wherein when an external electrical power source is applied between the upper or lower enclosure and the outer conductive section of said spray head valve support structure an electrical current flows sequentially from the upper or lower enclosure, the second electrical input, the first electrical input, a capacitor and through the opening on said spray head valve support structure, said actuator is energized causing said spray head valve to open and allow the fluid in the aerosol spray can to be sprayed when the spray head is operated.

11. The anti-graffiti aerosol spray can as recited in claim 10 wherein said spray head valve actuator is comprised of a solenoid.

12. The anti-graffiti aerosol spray can as recited in claim 10 wherein said spray head valve actuator is comprised of a valve.

13. The anti-graffiti aerosol spray can as recited in claim 10 wherein said spray head valve actuator is comprised of a muscle wire.

14. The anti-graffiti aerosol spray can as recited in claim 10 wherein said spray head valve actuator comprises:

a) an RF receiver having an output connected across the upper or lower enclosure and the outer conductive section of said spray head valve support structure, and b) a remotely located RF transmitter that is powered by a d-c power supply connected to a 120-vac, 60 Hz utility power, wherein when said RF transmitter is energized an RF signal is transmitted that is received by said RF receiver, wherein when said RF receiver is energized on RF signal produced by the receiver enables said spray valve actuator is actuated which allows the fluid in said aerosol spray can to be sprayed.

15. The anti-graffiti aerosol spray can as recited in claim 10 wherein said external electrical power source provides a low-voltage high-frequency power source.

16. The anti-graffiti aerosol spray can as recited in claim 10 wherein said electrical power source supplies 6-volts to 12-volts at a frequency of 1000 HZ.

* * * * *